US006896625B2

(12) United States Patent
Grace

(10) Patent No.: US 6,896,625 B2
(45) **Date of Patent: *May 24, 2005**

(54) HIGH MOMENT OF INERTIA PUTTER HAVING ADJUSTABLE WEIGHTS

(75) Inventor: Robert M. Grace, St. Pete Beach, FL (US)

(73) Assignee: MacGregor Golf Company, Albany, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/604,737

(22) Filed: Aug. 13, 2003

(65) Prior Publication Data

US 2004/0138003 A1 Jul. 15, 2004

Related U.S. Application Data

(63) Continuation-in-part of application No. 10/250,070, filed on Jun. 2, 2003, which is a continuation-in-part of application No. 10/248,342, filed on Jan. 10, 2003.

(51) Int. Cl.[7] ..... A63B 69/36; A63B 53/04; A63B 53/06

(52) U.S. Cl. ..... 473/251; 473/335; 473/338; 473/339; 473/340; 473/349

(58) Field of Search ..... 473/324–350, 473/290–292, 244, 251

(56) References Cited

U.S. PATENT DOCUMENTS

| | | | | | |
|---|---|---|---|---|---|
| 1,901,562 | A | * | 9/1933 | Main et al. | 473/300 |
| 3,042,405 | A | * | 7/1962 | Solheim | 473/313 |
| 3,143,349 | A | * | 8/1964 | Macintyre | 473/338 |
| 3,770,279 | A | * | 11/1973 | Phinny | 473/313 |
| 4,010,958 | A | * | 3/1977 | Long | 473/341 |
| 4,828,266 | A | * | 5/1989 | Tunstall | 473/336 |
| 4,898,387 | A | * | 2/1990 | Finney | 473/341 |
| 5,058,895 | A | * | 10/1991 | Igarashi | 473/341 |
| 5,433,444 | A | * | 7/1995 | Chiuminatta et al. | 473/240 |
| 5,620,379 | A | * | 4/1997 | Borys | 473/13 |
| 5,630,765 | A | * | 5/1997 | Moore | 473/252 |
| 5,685,784 | A | * | 11/1997 | Butler | 473/340 |
| 5,830,078 | A | * | 11/1998 | McMahan | 473/252 |
| 5,871,407 | A | * | 2/1999 | Tseng | 473/328 |
| 6,059,669 | A | * | 5/2000 | Pearce | 473/339 |
| 6,080,070 | A | * | 6/2000 | Whitley | 473/340 |
| 6,471,600 | B2 | * | 10/2002 | Tang et al. | 473/242 |
| 2003/0092503 | A1 | * | 5/2003 | Snowdon | 473/340 |
| 2003/0144077 | A1 | * | 7/2003 | Cullen | 473/340 |
| 2003/0228925 | A1 | * | 12/2003 | Rohrer | 473/251 |
| 2003/0232661 | A1 | * | 12/2003 | Greer | 473/340 |
| 2003/0236130 | A1 | * | 12/2003 | Gammon | 473/293 |

* cited by examiner

*Primary Examiner*—Sebastiano Passaniti
(74) *Attorney, Agent, or Firm*—Burns, Doane, Swecker & Mathis, L.L.P.

(57) ABSTRACT

A golf putter head of triangular shape. A ball-striking leading wall has a first breadth greater than a second breadth of a trailing wall. The leading and trailing walls are interconnected at their respective opposite ends by sidewalls that converge toward one another. A web interconnects the leading and trailing walls along a longitudinal axis of the golf putter head. A first embodiment may include a trailing copper weight and side wall aluminum weights. A second embodiment may include three copper weights, a third embodiment may include three copper-tungsten weights, and a fourth embodiment may include three tungsten weights. The weights are removable so that a putter having a low swingweight or a high swingweight can be brought up to or down to a standard swingweight. The weights may also be mixed in the second, third, and fourth embodiments.

30 Claims, 2 Drawing Sheets

FIG. 1
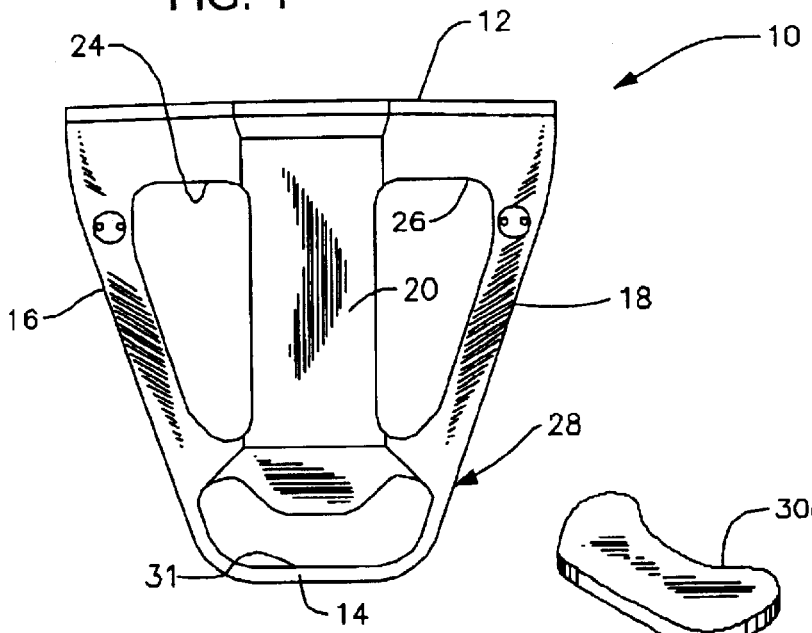
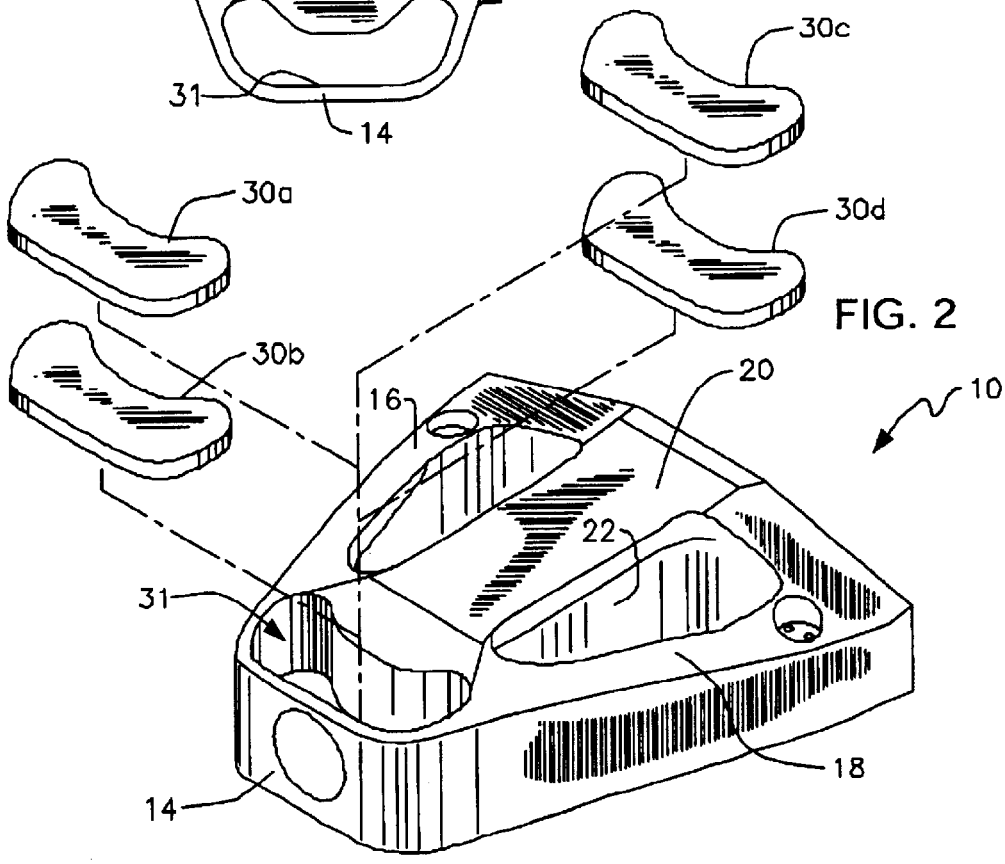
FIG. 2

FIG. 3
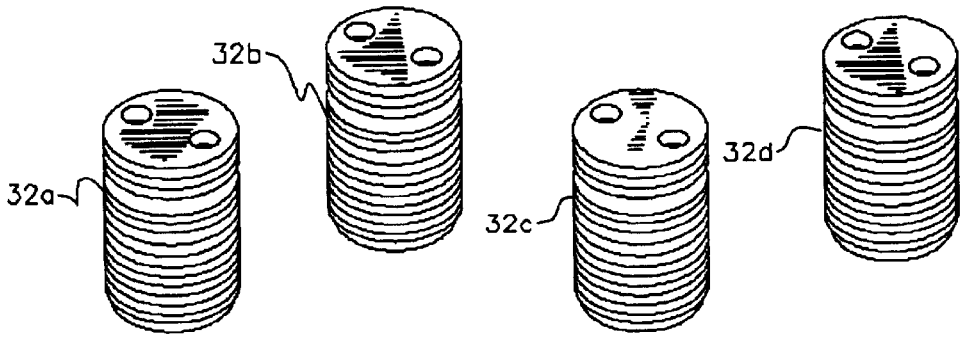
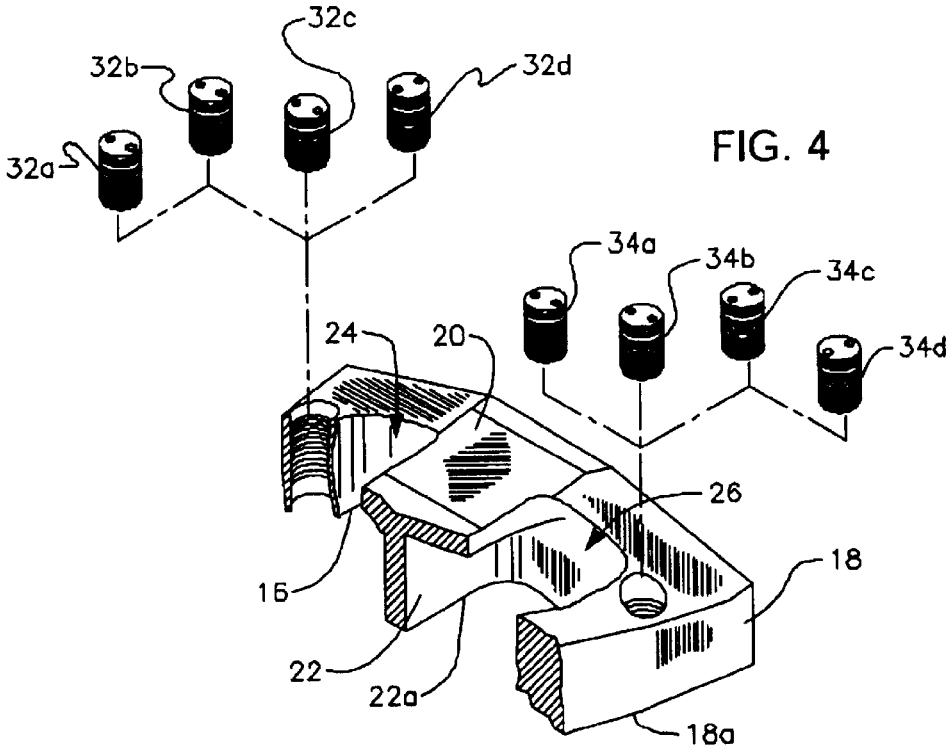
FIG. 4

HIGH MOMENT OF INERTIA PUTTER HAVING ADJUSTABLE WEIGHTS

CROSS-REFERENCE TO RELATED DISCLOSURES

This disclosure is a continuation-in-part of application Ser. No. 10/250,070, filed Jun. 2, 2003, entitled "High Moment Of Inertia Putter Having Three Weights" which disclosure is a continuation-in-part of application Ser. No. 10/248,342, filed Jan. 10, 2003, entitled "High Moment Of Inertia Putter," all by the same inventor. Both of said earlier disclosures are hereby incorporated into this disclosure by reference.

BACKGROUND OF THE INVENTION

1. Field of the Invention

This invention relates, generally, to golf putters. More particularly, it relates to a high moment of inertia golf putter of generally triangular configuration having adjustable weights.

2. Description of the Prior Art

In a perfect putt, a golfer strikes a golf ball exactly on the sweet spot of a putter head. This prevents the putter head from twisting about an axis of rotation defined by the golf club shaft. However, when the sweet spot is missed, the inertia offered by the ball imparts a torque to the golf club shaft. The torque increases in direct proportion to the distance by which the sweet spot is missed.

A putter head having a high moment of inertia resists the torque caused by missing the sweet spot to a greater degree than a putter head having a low moment of inertia. Putter heads having high moments of inertia are typically very wide and have weights attached to their outermost points. Most golfers prefer to play, however, with normal-sized, attractive putter heads rather than obviously over-sized putter heads.

Accordingly, there is a need for an attractive golf club putter head having a substantially normal width or breadth that provides a very high moment of inertia.

Golfers of varying heights use clubs having shafts of varying lengths. A shaft having a length of thirty five inches (35") is considered to be the standard because it is used by players of average height. Some shafts are only thirty two inches (32") and some are as long as thirty six inches (36").

If a club having a shaft length less than that of a standard shaft is fitted with a putter head that weighs the same as a putter head used with a standard shaft, the club will feel too light when it is swung. More particularly, the club will be said to have a low swingweight.

Conversely, if a club having a shaft length greater than that of a standard shaft is fitted with a putter head that weighs the same as a putter head used with shafts of standard length, the club will feel too heavy when swung and will be said to have a high swingweight.

Since putter heads generally weigh about the same, this means that golfers of shorter-than-average height and taller-than-average height are disadvantaged relative to golfers of average height. The swingweight experienced by a shorter-than-average golfer will be below the swingweight experienced by a golfer of average height and the swingweight experienced by a taller-than-average golfer will be above the swingweight experienced by a golfer of average height. This gives a golfer of average height a competitive advantage over golfers of non-average height.

A "swingweight" scale has been developed that quantifies the relationship between the weight of a putter head and the length of a golf club shaft. The swingweight scale includes a plurality of large classifications including "B," "C," "D," "E," "F," and "G." Moreover each large classification is further divided into more precise classifications such as "B-1 B-8," "C-1 C-8," and so on. This swingweight classification system is more than sixty (60) years old.

The "D" range is considered the standard range. More particularly, clubs having a swingweight in the range of "D-2" to "D-5" are considered to be in the optimal range.

Thus, a club with a shorter-than-average shaft but having a putter head weight the same as the putter head weight of a standard club will be classified as having a "B" or "C" swingweight. A club with a longer-than-average shaft but having a putter head weight equal to the putter head weight of a standard club will be classified as having an "E," "F ," or "G" swingweight.

A club having rating in the high "C" range is considered to be just as good as a club in the "D-2 D-5" range by some experts. In other words, a difference can be felt between a club in the "D-2 D-5 range and a club in the high "C" range but the difference is not considered to be particularly significant.

Accordingly, a club having a "B," "low C," "high D," "E," "F," or "G" swingweight is generally less desirable than a club having a "C-8" or "D1–D5" swingweight.

It would be advantageous if a club having a shaft length less than the standard length could be made to have a "D-2 D-5" swingweight. It would be equally advantageous if a club having a shaft length greater than the standard length could be made to have a "D-2 D-5 swingweight.

However, in view of the prior art considered as a whole at the time the present invention was made, it was not obvious to those of ordinary skill in the pertinent art how such need could be fulfilled.

SUMMARY OF INVENTION

The long-standing but heretofore unfulfilled need for a means whereby a putter having a low swingweight may be adjusted to have a standard swingweight and a means whereby a putter having a high swingweight may be adjusted to have a standard swingweight is now met by a new, useful, and nonobvious invention. The invention also fulfills the long-standing need for an attractive golf club putter head having a substantially normal width or breadth that provides a very high moment of inertia.

The novel golf putter head includes a main body having a generally triangular configuration. A leading wall of the main body has a first breadth, a top edge and a bottom edge. A trailing wall of the main body has a second breadth less than said first breadth, a top edge, and a bottom edge.

A first sidewall interconnects a first end of the leading wall and a first end of the trailing wall. A second sidewall interconnects a second end of the leading wall and a second end of the trailing wall.

A soleplate interconnects the bottom edge of the leading wall and the bottom edge of the trailing wall. The soleplate has a breadth less than the breadth of the trailing wall. The soleplate is normal to the leading wall and the trailing wall and has a length greater than the breadth of the leading wall.

A cavity is formed in the main body, bounded on four sides by the leading wall, the trailing wall, the first sidewall, and the second sidewall. The cavity is unbounded on a top end and is partially bounded on a lower end by the soleplate.

The trailing wall is spaced in trailing relation to the leading wall by a sufficient distance to position a center of gravity of the putter head about two-thirds of the way between the leading wall and the trailing wall. Accordingly, the center of gravity is closer to the trailing wall than to the leading wall. Such positioning of the center of gravity provides an enhanced moment of inertia to minimize the effects of a putt that misses a sweet spot on a ball-striking surface that is adapted to be mounted to the leading wall.

The trailing part of the putter head is defined as the part between the trailing wall of the putter head and the respective trailing ends of the cavity.

In a preferred embodiment, an upstanding web is disposed in interconnecting relation between the leading wall and the trailing wall and is formed integrally with the sole plate upon which it is mounted. The web is disposed normal to the leading wall and the trailing wall. The cavity is therefore divided into two cavities by the web. Thus, the web transmits forces applied to the leading wall at least in part to the trailing wall so that resistance offered by the trailing wall supplements resistance offered by the leading wall to the applied forces.

The soleplate and web are centered on a longitudinal axis of symmetry of the golf putter head. More particularly, the web is disposed on the longitudinal axis of the golf putter head and divides the cavity into two cavities of equal size.

In this invention, a first weight-receiving cavity is formed in a trailing part of the putter head and is therefore known as the trailing weight-receiving cavity.

The weight adapted to be received within said trailing weight-receiving cavity is hereinafter referred to as the trailing weight.

A second weight-receiving cavity is formed in the first sidewall, just rearwardly of the leading wall, and a third weight-receiving cavity is formed in the second sidewall, just rearwardly of the leading wall. Both the second and third weight-receiving cavities are internally threaded. Said cavities are hereinafter respectively referred to as the first and second sidewall weight-receiving cavities.

The weights that are screw-threadedly received within said first and second sidewall receiving cavities are hereinafter respectively referred to as the first and second sidewall weights.

Each of said weight-receiving cavities is adapted to selectively and releasably receive a plurality of weight members of differing weights. The weights may range from relatively light aluminum weights to copper weights that weigh more than the aluminum weights to heavier still copper-tungsten weights that out-weigh the copper weights up to tungsten weights that weigh more than the copper-tungsten weights. The use of different metals or other materials of differing weights is within the scope of this invention.

In the preferred embodiment of this invention, a first, second, third, or fourth weight means is releasably received within the trailing weight-receiving cavity and the first and second sidewall weight-receiving cavities to further enhance the moment of inertia and to bring the swingweight of the putter into the standard range.

Selective use of the aluminum, copper, copper-tungsten, and tungsten weights thus raises the swingweight of a low swingweight putter and decreases the swingweight of a high swingweight putter.

An important object of this invention is to provide a golf putter head having multiple weight-receiving cavities where each cavity is adapted to receive weight members of varying weights.

A more specific object is to provide a means whereby the swingweight of a club having a shaft length less than a standard shaft length is increased to a swingweight comparable to that of a class "D" or high "C" class putter.

An equally important object is to provide a means whereby the swingweight of a club having a shaft length greater than a standard shaft length is decreased to a swingweight comparable to that of a class "D" or high "C" class putter.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 1 is a top plan view of the novel putter head;

FIG. 2 is an exploded bottom perspective view depicting how the novel trailing weight members of this invention are selectively connected to the novel putter head;

FIG. 3 is a perspective view of the novel first and second sidewall weight members of this invention; and FIG. 4 is a broken away, partial bottom perspective view depicting how the novel first and second sidewall weight members are selectively connected to the novel putter head.

DETAILED DESCRIPTION

Referring to FIGS. 1 and 2, it will there be seen that the reference numeral 10 denotes an illustrative embodiment of the present invention as a whole. Novel putter head 10 is generally triangular-shaped; more accurately, the shape is that of a trapezoid with rounded corners.

Golf putter head 10 includes transversely disposed leading wall 12. In a first embodiment, the breadth of leading wall 12 is only three and three quarter inches (3.75"). In a second embodiment, the breadth of said leading wall is only four inches (4") and in a third embodiment, said breadth is only five inches (5"). This distinguishes putter head 10 from any high moment of inertia putter head that relies upon a very wide, unaesthetic leading wall.

The putter head having a breadth of three and three quarter inches (3.75") is about ten percent (10%) smaller than a putter head having a breadth of four inches (4").

Golf putter head 10 further includes transversely disposed trailing wall 14 that is parallel with leading wall 12. The breadth, width, or transverse extent of leading wall 12 is greater than the breadth, width, or transverse extent of trailing wall 14.

First sidewall 16 interconnects a first end of leading wall 12 and a first end of trailing wall 14. Second sidewall 18 interconnects a second end of leading wall 12 and a second end of trailing wall 14. Accordingly, sidewalls 16 and 18 converge toward one another from said leading wall to said trailing wall.

Note that the longitudinal extent from leading wall 12 to trailing wall 14 is greater than the transverse extent of said leading wall 12. It is also worth observing that trailing wall 14 is centered with respect to the sweet spot of the putter head, rearwardly thereof, and has a truncate breadth so that its opposite ends are positioned close to the longitudinal axis of symmetry of the putter head, it being understood that said sweet spot is centered on said longitudinal axis of symmetry.

Soleplate 20 is disposed in interconnecting relation between leading wall 12 and trailing wall 14 and is centered with a longitudinal axis of symmetry of golf putter head 10. More particularly, soleplate 20 interconnects a bottom edge of leading wall 12 and a bottom edge of trailing wall 14. Forces applied to leading wall 12 are therefore transmitted to trailing wall 14 by said soleplate and by sidewalls 16, 18 as well.

Upstanding web 22 (FIG. 4) is mounted on and projects upwardly from soleplate 20 and is coincident with the longitudinal axis of symmetry of putter head 10. Web 22 is depicted in depending relation to soleplate 20 because FIG. 4 is a bottom perspective view. Top edge 22*a* of web 22 is flush with top edge 16*a* of sidewall 16 and top edge 18*a* of sidewall 18.

With the exception of soleplate 20 and web 22, the space peripherally bounded by leading wall 12, trailing wall 14, and sidewalls 16, 18 is empty, i.e., putter head 10 is substantially of hollow construction. Thus it is understood that web 22 divides that hollow space into cavities 24 and 26. Cavities 24, 26 reduce the weight of putter head 10 and enable the center of gravity of said putter head to be positioned on the trailing side of leading wall 12.

Although not depicted, a plurality of material and weight-saving apertures may be formed in side walls 16, 18, and web 22.

Cavities 24, 26 do not extend all the way to trailing wall 14. Thus, a large part of the mass of putter head 10 is provided in trailing end 28 thereof, thereby positioning the center of gravity of putter head 10 in trailing relation to leading wall 12. If putter head 10 is made of a single material, such as stainless steel, the moment of inertia will still be high but will be less than a moment of inertia achieved by weighting said trailing end.

The center of gravity and the moment of inertia are not substantially affected if a first trailing weight member 30*a* (FIG. 2) is introduced into trailing weight-receiving cavity 31 if said first trailing weight member 30*a* is formed of the same material as putter head 10. Thus, where putter head 10 is formed of aluminum and first trailing weight member 30*a* is also formed of aluminum, the moment of inertia and the swingweight of the club are substantially unaffected. Thus, theoretically, where a club has a standard length shaft, an aluminum club head, and a swingweight in the range of "D-2 D-5," an aluminum weight member 30*a* is secured into position in trailing weight-receiving cavity 31. As a practical matter, such a club would not be manufactured with any weight-receiving cavities.

The center of gravity is moved further from leading wall 12, and the moment of inertia thereby increased, by placing a second trailing weight member 30*b* formed of copper into said trailing weight-receiving cavity 31, in lieu of said aluminum trailing weight member 30*a*.

The center of gravity is moved still further from leading wall 12, and the moment of inertia thereby further increased, by placing a third trailing weight member 30*c* formed of copper and tungsten, having a greater weight than said first and second weight members, into said trailing weight-receiving cavity 31, in lieu of said copper trailing weight member 30*b*.

The center of gravity is moved still further from leading wall 12, and the moment of inertia thereby further increased, by placing a fourth trailing weight member 30*d*, formed of tungsten, having a greater weight than the first, second, and third weight members, into said trailing weight-receiving cavity 31, in lieu of said copper-tungsten trailing weight member 30*c*.

Weight-receiving cavity 31 is milled into trailing end 28 to selectively accommodate each of said weight members, and each weight member is flush with the top of cavity 31 when the weight member is secured therewithin by suitable fastening means. The fasteners disclosed in the parent disclosure, or suitable equivalents thereof, are used to releasably secure the weight members into said weight-receiving cavity.

As depicted in FIGS. 3 and 4, first side wall first weight member 32*a* is formed of aluminum, first side wall second weight member 32*b* is formed of copper, first side wall third weight member 30*c* is formed of copper-tungsten, and first side wall weight member 32*d* is formed of tungsten.

Second side wall first weight member 34*a* is formed of aluminum, second side wall second weight member 34*b* is formed of copper, second side wall third weight member 34*c* is formed of copper-tungsten, and second side wall weight member 34*d* is formed of tungsten.

In a preferred embodiment, the first and second side wall weight members are externally threaded for screw-threaded engagement with their associated internally threaded first and second weight-receiving cavities. However, other releasable connection means are within the scope of this invention.

For best results in most putter heads, the weight members are not mixed with one another. Thus, if a selected trailing weight member is formed of copper-tungsten, then the first and second side wall weight members usable therewith should also be formed of copper-tungsten. However, mixed weights are also within the scope of this invention, i.e., the claims appended hereto are not avoided by a putter head having a trailing weight formed of tungsten and first and second side wall weights formed of copper, for example.

The row headings of the following table include the respective head weights of various putters in grams and the moment of inertia of the putter. The head weights are of the head only and do not include the weights of the shaft and the grip. The column headings include the various lengths of shafts. The cells of the table include the swingweight of each combination. This table applies to a putter head having a leading wall of three and three quarter inch (3.75") breadth. In view of the disclosure made herein, similar tables may be generated for putter heads having leading walls of four inch (4") and five inch (5") breadth.

| Head weight in grams–Swingweight | | | | | |
|---|---|---|---|---|---|
| 340 grams (aluminum)4390 M.O.I. | B-6 | C-5 | D-3 | E-1 | E-8 |
| 352 grams(copper) 4600 M.O.I. | B-9 | C-9 | D-8 | E-7 | F-3 |
| 365 grams(copper-tungsten)4950 M.O.I. | C-4 | D-4 | E-3 | F-2 | F-8 |
| 375 grams(tunsten) 5200 M.O.I. | C-8 | D-8 | E-7 | F-6 | G-1 |

The very high moments of inertia achieved by these embodiments of the inventive putter head have never before been achieved in a golf putter having a leading wall that is only three and three quarter inches (3.75") in breadth or in a golf putter head that weighs under 375 grams or in a putter head of such an acceptable size.

Where the putter head leading wall has a breadth of four inches (4"), the moment of inertia ranges from 5890 gm $cm^2$ to 6900 gm $cm^2$ where the trailing weight is selected from the group consisting of copper and copper-tungsten weights and where the first and second side wall weights are selected from the group consisting of aluminum, copper, copper-tungsten, and tungsten weights.

Where the putter head leading wall has a breadth of five inches (5"), the moment of inertia ranges from 11,000 gm $cm^2$ to 14,500 gm $cm^2$, where the trailing weight is a copper-tungsten weight and wherein the first and second side wall weights are selected from the group consisting of aluminum, copper, copper-tungsten, and tungsten weights.

The primary advantage of this invention is the ability to change the swingweight of a putter having a shorter-than-average shaft to a standard swingweight, and to change the swingweight of a putter having a longer-than-average shaft to a standard swingweight. Thus, a short shaft putter having a swingweight in the "B" or "C" category can be brought into the standard "D2–D5" category, and a long shaft putter having a swingweight in the "E," "F," or "G" swingweight category can be brought into the standard "D2–D5" swingweight category.

Each weight requires removal by a special tool to bring the putter into compliance with USGA rules. The manufacturer of the putter is enabled by this invention to provide short shaft clubs and long shaft having ideal swingweights. This has never been achieved prior to this invention.

The claims that follow are therefore understood to be drawn to a pioneering invention and as such are entitled to a broad construction that protects the heart or essence of this breakthrough invention.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. A golf putter head, comprising:

a main body having a generally triangular configuration;

said main body having a leading wall having a first breadth;

said leading wall having a top edge and a bottom edge;

said main body having a trailing wall having a second breadth less than said first breadth;

said trailing wall having a top edge and a bottom edge;

a first sidewall interconnecting a first end of said leading wall and a first end of said trailing wall;

a second sidewall interconnecting a second end of said leading wall and a second end of said trailing wall;

a soleplate interconnecting said bottom edge of said leading wall and said bottom edge of said trailing wall;

said soleplate having a breadth less than said second breadth of said trailing surface;

a cavity formed in said main body, said cavity bounded on four sides by said leading wall, said trailing wall, said first sidewall, and said second sidewall;

said cavity being unbounded on a top end and being partially bounded on a lower end by said soleplate;

a ball-striking surface adapted to be mounted to said leading wall;

said soleplate being normal to said leading wall and said trailing wall;

a first trailing weight-receiving cavity formed in said trailing wall;

a plurality of trailing weight members of differing weights adapted to be releasably and selectively positioned within said trailing weight-receiving cavity;

a first side wall weight-receiving cavity formed in said first side wall;

a plurality of first side wall weight members of differing weights adapted to be releasably and selectively positioned within said first side wall weight-receiving cavity;

a second side wall weight-receiving cavity formed in said second side wall;

a plurality of second side wall weight members of differing weights adapted to be releasably and selectively positioned within said second side wall weight-receiving cavity;

whereby the swingweight of a putter is adjusted by preselecting weight members from said plurality of trailing weight members and said plurality of first and second side wall weight members.

2. The golf putter head of claim 1, further comprising:

a web disposed in interconnecting relation between said leading wall and said trailing wall;

said web being disposed normal to said leading wall and said trailing wall;

said cavity being divided into two cavities by said web;

whereby said web transmits forces applied to said leading wall at least in part to said trailing wall;

whereby resistance offered by said leading wall to said applied forces is supplemented by resistance offered by said trailing wall.

3. The golf putter head of claim 2, further comprising:

said soleplate being centered on a longitudinal axis of symmetry of said golf putter head;

said web being mounted in upstanding relation to said soleplate;

said web being disposed on said longitudinal axis of said golf putter head and dividing said cavity into two cavities of equal size.

4. The golf putter head of claim 1, wherein said leading wall of said golf putter head is about 3.7 to 4.0 inches in breadth.

5. The golf putter head of claim 1, further comprising:

said plurality of trailing weight members including a first trailing weight member;

said plurality of first and second side wall weight members including a first side wall weight member and a second side wall weight member;

said first trailing weight member being formed of copper and said first and second side wall weight members being formed of aluminum;

said golf putter head having a total weight of about three hundred forty grams; and said golf putter head having a moment of inertia of about 4390 gm $cm^2$.

6. The golf putter head of claim 5, wherein the swingweight of a club having a thirty two inch shaft and said golf putter head has a swingweight of B-6.

7. The golf putter head of claim 5, wherein the swingweight of a club having a thirty three inch shaft and said golf putter head has a swingweight of C-5.

8. The golf putter head of claim 5, wherein the swingweight of a club having a thirty four inch shaft and said golf putter head has a swingweight of D-3.

9. The golf putter head of claim 5, wherein the swingweight of a club having a thirty five inch shaft and said golf putter head has a swingweight of E-1.

10. The golf putter head of claim 5, wherein the swingweight of a club having a thirty six inch shaft and said golf putter head has a swingweight of E-8.

11. The golf putter head of claim 1, further comprising:

said plurality of trailing weight members including a first trailing weight member;

said plurality of first and second side wall weight members including a first side wall weight member and a second side wall weight member;

said first trailing weight member and said first and second side wall weight members being formed of copper;

said golf putter head having a total weight of about three hundred fifty two grams; and said golf putter head having a moment of inertia of about 4600 gm $cm^2$.

12. The golf putter head of claim 11, wherein the swingweight of a club having a thirty two inch shaft and said golf putter head has a swingweight of B-9.

13. The golf putter head of claim 11, wherein the swingweight of a club having a thirty three inch shaft and said golf putter head has a swingweight of C-9.

14. The golf putter head of claim 11, wherein the swingweight of a club having a thirty four inch shaft and said golf putter head has a swingweight of D-8.

15. The golf putter head of claim 11, wherein the swingweight of a club having a thirty five inch shaft and said golf putter head has a swingweight of E-7.

16. The golf putter head of claim 11, wherein the swingweight of a club having a thirty six inch shaft and said golf putter head has a swingweight of F-3.

17. The golf putter head of claim 1, further comprising:

said plurality of trailing weight members including a first trailing weight member;

said plurality of first and second side wall weight members including a first side wall weight member and a second side wall weight member;

said first trailing weight member being formed of copper and said first and second side wall weight members being formed of copper-tungsten;

said golf putter head having a total weight of about three hundred sixty five grams; and said golf putter head having a moment of inertia of about 4950 gm $cm^2$.

18. The golf putter head of claim 17, wherein the swingweight of a club having a thirty two inch shaft and said golf putter head has a swingweight of C-4.

19. The golf putter head of claim 17, wherein the swingweight of a club having a thirty three inch shaft and said golf putter head has a swingweight of D-4.

20. The golf putter head of claim 17, wherein the swingweight of a club having a thirty four inch shaft and said golf putter head has a swingweight of E-3.

21. The golf putter head of claim 17, wherein the swingweight of a club having a thirty five inch shaft and said golf putter head has a swingweight of F-2.

22. The golf putter head of claim 17, wherein the swingweight of a club having a thirty six inch shaft and said golf putter head has a swingweight of F-8.

23. The golf putter head of claim 1, further comprising:

said plurality of trailing weight members including a first trailing weight member;

said plurality of first and second side wall weight members including a first side wall weight member and a second side wall weight member;

said first trailing weight member being formed of copper and said first and second side wall weight members being formed of tungsten;

said golf putter head having a total weight of about three hundred seventy five grams; and said golf putter head having a moment of inertia of about 5200 gm $cm^2$.

24. The golf putter head of claim 23, wherein the swingweight of a club having a thirty two inch shaft and said golf putter head has a swingweight of C-8.

25. The golf putter head of claim 23, wherein the swingweight of a club having a thirty three inch shaft and said golf putter head has a swingweight of D-8.

26. The golf putter head of claim 23, wherein the swingweight of a club having a thirty four inch shaft and said golf putter head has a swingweight of E-7.

27. The golf putter head of claim 23, wherein the swingweight of a club having a thirty five inch shaft and said golf putter head has a swingweight of F-6.

28. The golf putter head of claim 23, wherein the swingweight of a club having a thirty six inch shaft and said golf putter head has a swingweight of G-1.

29. The golf putter head of claim 1, wherein said golf putter head leading wall has a breadth of four inches (4"), where said trailing weight is selected from the group consisting of copper and copper-tungsten weights, wherein said first and second side wall weights are selected from the group consisting of aluminum, copper, copper-tungsten, and tungsten weights, and wherein said golf putter head has a moment of inertia that ranges from 5890 gm $cm^2$ to 6900 gm $cm^2$.

30. The golf putter head of claim 1, wherein said golf putter head leading wall has a breadth of five inches (5"), wherein said trailing weight is a copper-tungsten weight, wherein said first and second side wall weights are selected from the group consisting of aluminum, copper, copper-tungsten, and tungsten weights, and wherein said golf putter head has a moment of inertia that ranges from 11,000 gm $cm^2$ to 14,500 gm $cm^2$.

* * * * *